US011267620B1

(12) United States Patent
Lu

(10) Patent No.: US 11,267,620 B1
(45) Date of Patent: Mar. 8, 2022

(54) PRESS TYPE SEALABLE CONTAINER

(71) Applicant: Ningbo Halson Import & Export Co., Ltd., Ningbo (CN)

(72) Inventor: Jiehua Lu, Ningbo (CN)

(73) Assignee: Ningbo Halson Import & Export Co., Ltd., Ningbo (CN)

( * ) Notice: Subject to any disclaimer, the term of this patent is extended or adjusted under 35 U.S.C. 154(b) by 0 days.

(21) Appl. No.: 17/376,172

(22) Filed: Jul. 15, 2021

(51) Int. Cl.
*B65D 43/02* (2006.01)
*B65D 45/32* (2006.01)

(52) U.S. Cl.
CPC ..... *B65D 43/021* (2013.01); *B65D 45/327* (2013.01); *B65D 2543/0099* (2013.01); *B65D 2543/00509* (2013.01); *B65D 2543/00685* (2013.01); *B65D 2543/00759* (2013.01); *B65D 2543/00888* (2013.01)

(58) Field of Classification Search
CPC ..... B65D 43/021; B65D 2543/0099; B65D 45/327; B65D 2543/00935; B65D 39/12
USPC ..... 220/234, 235, 236, 237, 238
See application file for complete search history.

(56) References Cited

U.S. PATENT DOCUMENTS

| | | | | |
|---|---|---|---|---|
| 4,895,457 | A | 1/1990 | Lancaster et al. | |
| 8,859,138 | B2 | 10/2014 | Fukuda et al. | |
| 10,000,319 | B2 | 6/2018 | Pisarevsky | |
| 2007/0241107 | A1* | 10/2007 | Matsumoto | B65D 39/12 220/238 |
| 2016/0107805 | A1* | 4/2016 | Luo | B65D 45/28 220/256.1 |

* cited by examiner

*Primary Examiner* — Jeffrey R Allen
(74) *Attorney, Agent, or Firm* — True Shepherd LLC; Andrew C. Cheng

(57) ABSTRACT

A press type sealable container includes a housing including an open-top wall structure defining a receptacle for receiving material to be stored; a cover designed to fit over the opening of the container and have a movable push-push type button. According to the disclosure, a toggle mechanism is used instead of a self-locking push switch in the press type sealable container, thereby enhancing the resistance to pressure of the press type sealable container and improving the durability of the overall structure. Accordingly, the technical problems of unsatisfactory holding strength, easy damage under excessive pressure exerted by the push-push type button and short service life are solved. Moreover, the toggle mechanism is simple to implement, good in reliability, and long in service life.

8 Claims, 6 Drawing Sheets

PRESS TYPE SEALABLE CONTAINER

TECHNICAL FIELD

The disclosure relates to a press type sealable container and belongs to the field of storage containers.

BACKGROUND

Existing storage containers in the market are mainly designed with a clamp structure, an easy-to-lock structure, and a press type structure.

A typical clamp structure allows a cover to be fastened over a container body with clasps disposed on two sides or around. Due to high strength of fastening, such structure can be well sealed but is inconvenient to use because all clasps need to be handled with two hands for opening and closing. An easy-to-lock container is usually provided with a cover with a knob or pull tab which can be used to control the tightness of a sealing washer on the cover. Such structure can provide a poor seal because of limited pressure posed by the sealing washer. A press type structure is relatively complicated, in which a push-push type button disposed at the top of a container is used to control extending and retracting and a higher pressure can be exerted on a sealing washer, thus improving the sealing performance. In addition, such a structure realizes opening and closing of the container by pressing the push-push type button with one hand, thereby achieving convenient operation.

In some covers designed with upper, middle and lower covers, a middle cover and a push-push type button can be locked in position for sealing by using a self-locking push switch. Such a self-locking push switch has a simple structure and mature process technology, but may still probably fail to lock. Meantime, the holding strength is unsatisfactory. Besides, the self-locking push switch is unable to bear excessive pressure exerted by the push-push type button and susceptible to damage with short service life.

SUMMARY

To overcome the shortcomings in the prior art, an objective of the disclosure is to provide a press type sealable container to solve the technical problem of poor durability of a press type sealable container in the prior art.

To achieve the above objective, the disclosure is implemented by using the following technical solutions.

A press type sealable container includes:

a housing including an open-top wall structure defining a receptacle for receiving material to be stored;

a cover disposable on the housing and have a movable push-push type button;

a sealing washer disposed around the bottom of the cover, where a seal is formed between the sealing washer and the wall of the housing only when the push-push type button is pressed and locked in position; and a toggle mechanism disposed in the cover to lock the push-push type button in position when the push-push type button is pressed and unlock the push-push type button when pressed again.

Preferably, the cover may include:

an upper cover fixedly connected to a lower cover at the bottom thereof and having a receptacle at the top thereof, where the push-push type button is fastened over the receptacle;

the receptacle, provided therein with a lifting mechanism and having an opening in a surface thereof; and a middle cover disposed movably up and down between the upper cover and the lower cover, where a spring is disposed between the upper cover and the lower cover; and the lifting mechanism, where the lifting mechanism extends through the opening to abut against the middle cover at the bottom thereof and abuts against the push-push type button at the top thereof.

Preferably, the lifting mechanism may consist of two turnable arms hinged in the receptacle, and a square facet may be disposed on an acute-angled side of a hinged joint of each turnable arm and the receptacle and capable of extending through the opening to abut against the middle cover for moving down when the turnable arm is pressed to turn by the push-push type button.

Preferably, the toggle mechanism may include:

an ejector pin fixed at an upper end thereof to an inner top wall of the push-push type button and connected at a lower end thereof to a tumbler which is capable of rotating freely, where a plurality of lugs are disposed around the tumbler and each lug has a bottom bevel and a top angular protrusion;

a barrel disposed in the receptacle in a position corresponding to the tumbler and sized to match the tumbler, where a plurality of sliding slots spaced as far apart as the lugs are formed in an inner peripheral wall of the barrel; and a tubular bulge formed on a top wall of the lower cover, where a plurality of positioning slots spaced as far apart as the lugs are formed in an inner peripheral wall of the tubular bulge and elongated sloping protrusions corresponding to the bottom bevels of the lugs are formed on a top wall of the tubular bulge; and a round hole corresponding to the tubular bulge is formed in a surface of the middle cover.

Preferably, an annular clamping slot may be formed circumferentially in the lower cover and a horizontal portion clamped in the clamping slot may be formed at a bottom end of the sealing washer.

Preferably, a plurality of tabs may be fixedly connected to the bottom of a side wall of the push-push type button and clasps corresponding to the tabs are disposed in the receptacle of the upper cover.

Preferably, the housing may be slightly flared on the open side and an end wall of the housing on the open side may be formed into an outwardly extending bevel structure.

Preferably, the bottom of the spring may be fixed to the lower cover by means of an annular protrusion formed at the top of the lower cover.

Preferably, a strip-shaped protrusion may be formed at an apex angle of the square facet and a strip-shaped slot corresponding to a moving track of the apex angle of the square facet may be formed in the surface of the middle cover.

Preferably, the sealing washer may have a bowl-shaped structure which is opened wider on an upper side than on a lower side thereof.

Compared with the prior art, the disclosure has the following advantages:

1. A toggle mechanism is used instead of a self-locking push switch in the press type sealable container, thereby enhancing the resistance to pressure of the press type sealable container and improving the durability of the overall structure. Accordingly, the technical problems of unsatisfactory holding strength, easy damage under excessive pressure exerted by the push-push type button and short service life are solved. Moreover, the toggle mechanism is simple to implement, good in reliability, and long in service life.

2. The square facet disposed on the acute-angled side of the hinged joint of each turnable arm and the upper cover is shaped like a triangle with an apex angle and capable of pressing against the middle cover for moving down when the turnable arm is pressed down to turn. The apex angle of the square facet is capable of exerting great pressure and good in stability without influence on the movement of other components.

3. When the middle cover is moved down, the bottom of the middle cover presses against the sealing washer, so that the distance between the sealing washer and the inner wall of the container is reduced gradually and the sealing washer is allowed to fit the inner wall of the container gradually to form a seal with great and uniform strength and good sealing effect.

Figure 1:
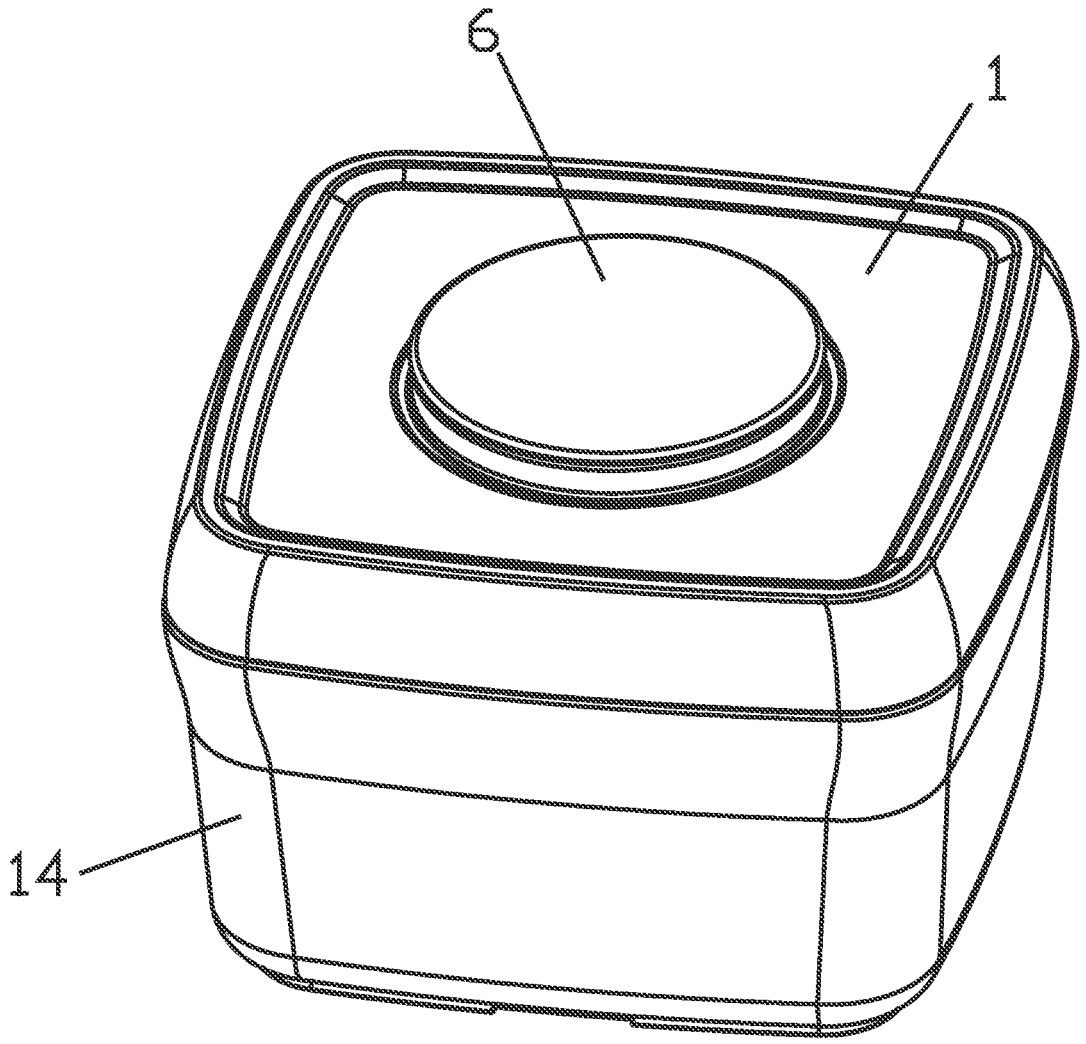
FIG. 1 is an overall schematic diagram of a container with a sealable cover according to an embodiment of the disclosure.

List of reference numerals: 1, upper cover, 2, middle cover, 3, lower cover, 4, sealing washer, 5, spring, 6, push-push type button, 7, turnable arm, 8, square facet, 9, strip-shaped slot, 10, ejector pin, 11, tumbler, 12, sliding slot, 13, positioning slot, and 14, housing.

DETAILED DESCRIPTION

The disclosure generally relates to a container with a sealable cover, and in particular, to a container for storage of food or other articles that can be sealed with the cover by pressing a push-push type button at the top of the cover. The disclosure will be further described below in conjunction with the accompanying drawings. The following embodiments are only used for describing the technical solutions of the disclosure more clearly and are not intended to limit the protection scope of the disclosure.

Referring to FIG. 1 to FIG. 5, a cover and a housing 14 are included, where food or other articles needing to be stored hermetically may be put in the housing 14. The housing 14 is slightly flared on the open side and an end wall of the housing 14 on the open side is formed into an outwardly extending bevel structure which can better match the cover in practical use. On the one hand, a larger area is provided for locking the cover. That is, the cover can be received readily. On the other hand, when the cover is pressed for sealing, with the open-side end wall of the housing 14 formed into an outwardly extending bevel, the distance between the sealing washer 4 and the open-side inner wall of the housing 14 is reduced gradually with the middle cover 2 in the cover body moving down, and the sealing washer 4 is allowed to fit the inner wall of the housing 14 gradually, thereby improving the sealing effect of the sealing washer 4. The specific structure of the cover will be described in detail below in conjunction with relevant drawings.

Figure 2:
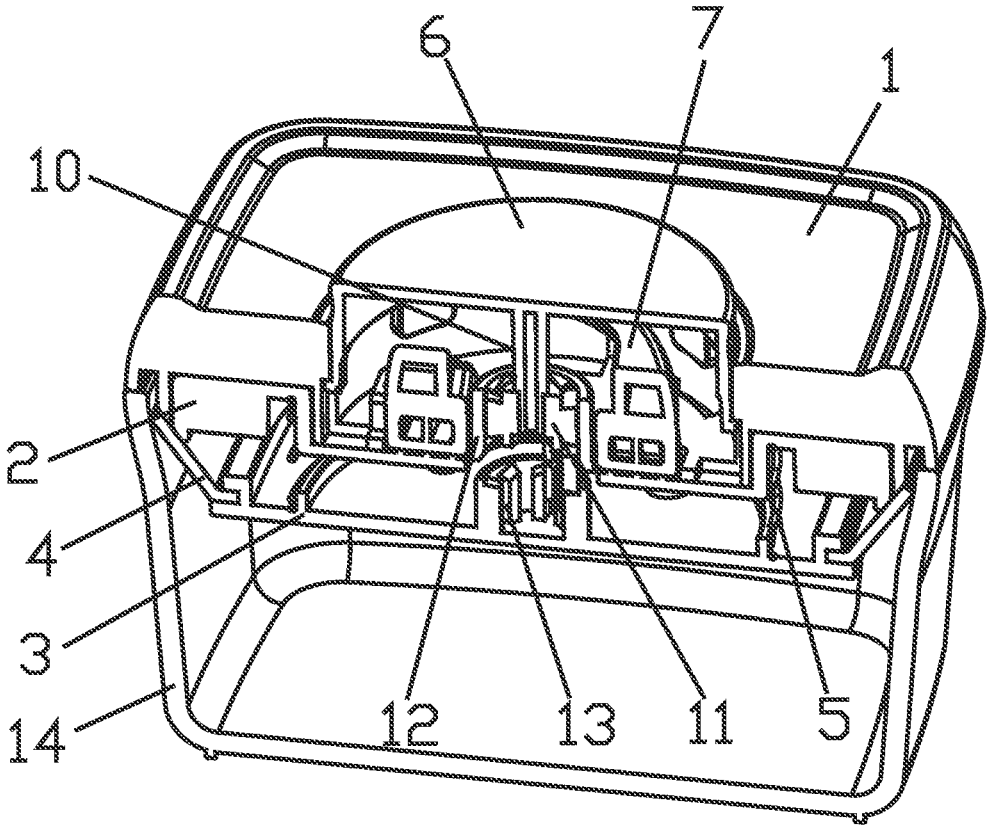
FIG. 2 is a cross-section diagram of the container with the sealable cover according to the embodiment of the disclosure.
Figure 3:
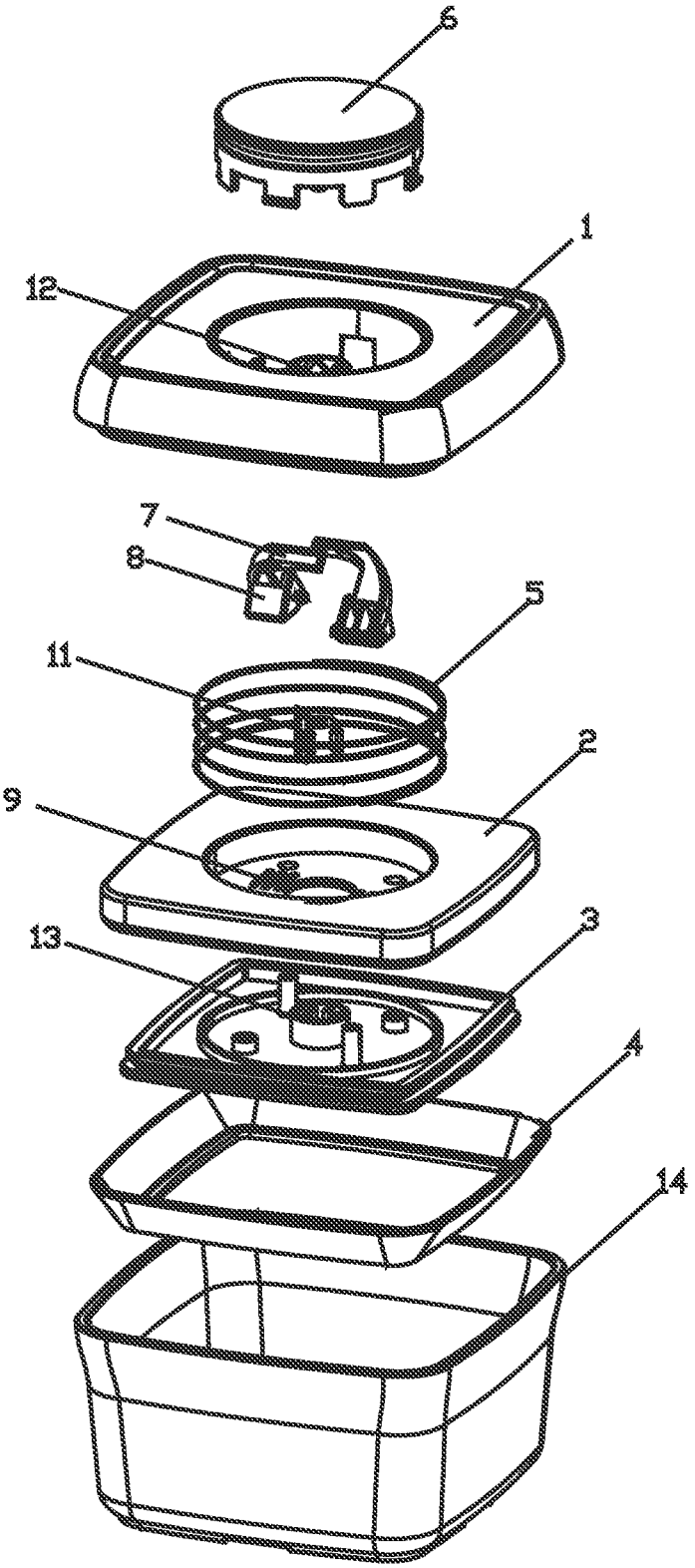
FIG. 3 is an exploded diagram of the container with the sealable cover according to the embodiment of the disclosure.
Figure 4:
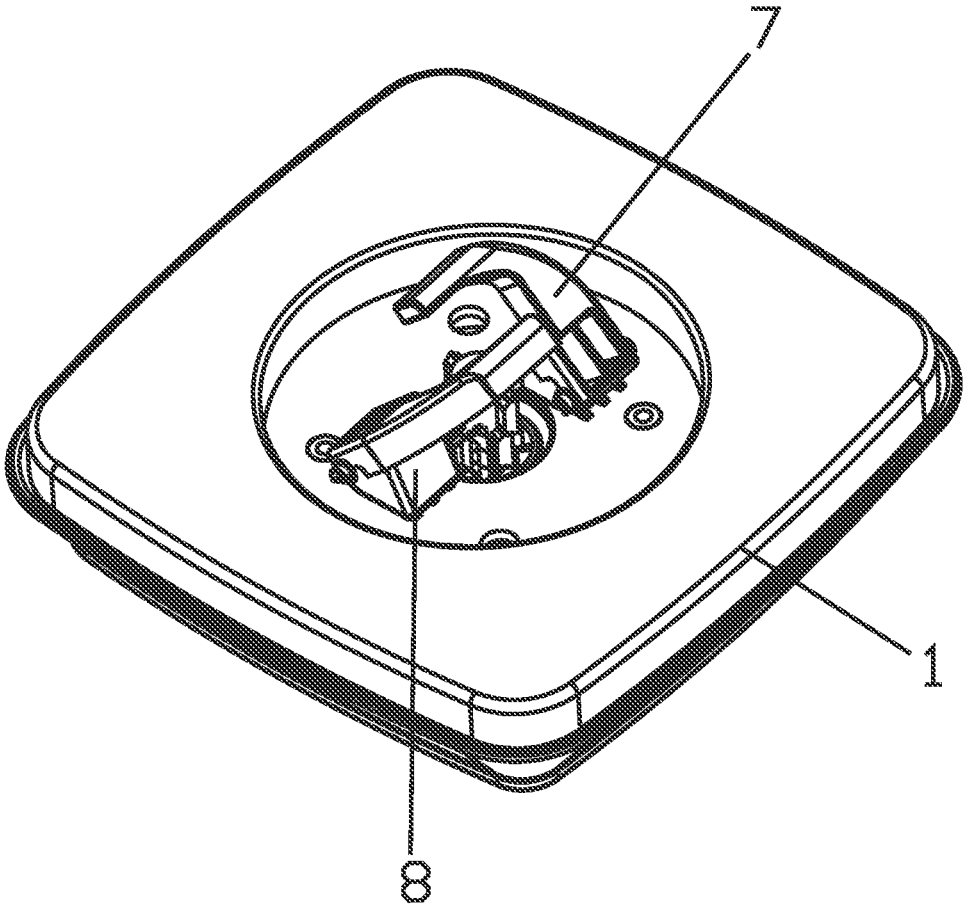
FIG. 4 is a partial structure diagram of a cover according to an embodiment of the disclosure.
Figure 5:
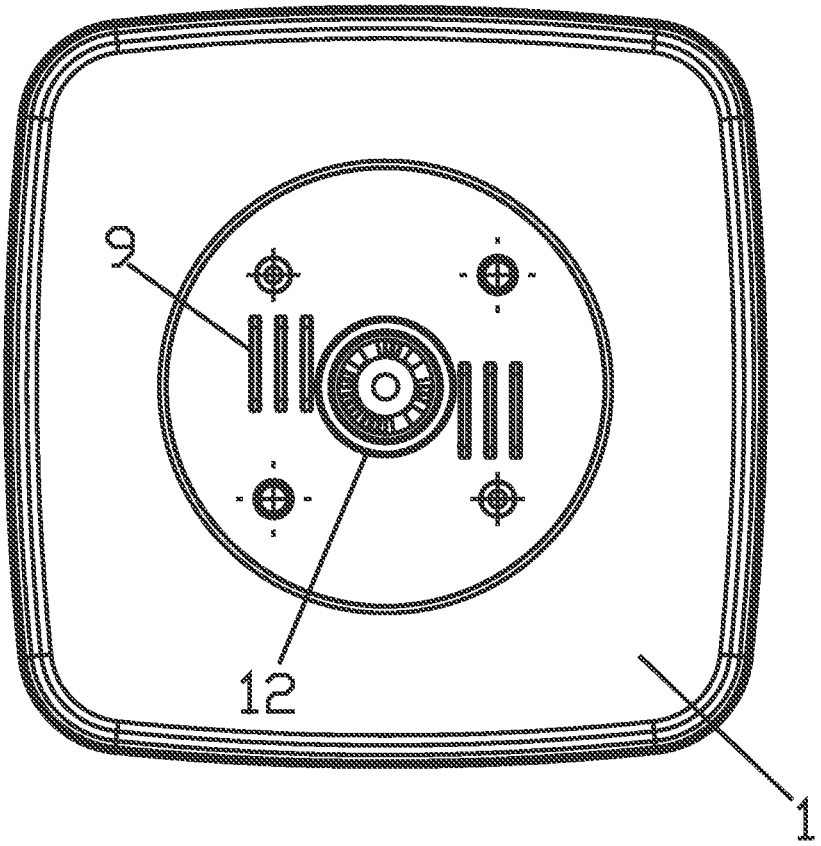
FIG. 5 is a top partial structure view of the cover according to the embodiment of the disclosure.

Referring to FIG. 2 and FIG. 3, the overall frame of the cover is configured with a three-layer cover structure. An upper cover 1 and a lower cover 3 are fixedly connected to define the overall frame of the cover, with space therebetween for the middle cover 2 to move. It needs to be noted that, to ensure better stability of the middle cover 2 when moving up and down, a plurality of joint levers are disposed on the inner top wall of the upper cover 1, while insert holes for matching the joint levers are formed in the top wall of the lower cover 3 and holes for the joint levers to extend through are formed in the surface of the middle cover 2. A sealing washer 4 is disposed around the lower cover 3. The sealing washer 4 is opened upwards and has a bowl-shaped structure which is opened wider on an upper side than on a lower side thereof. It needs to be noted that an annular clamping slot is formed circumferentially in the lower cover 3 and a horizontal portion clamped in the clamping slot is formed at a bottom end of the bowl-shaped sealing washer 4. The middle cover 2 is disposed movably up and down between the upper cover 1 and the lower cover 3, and when the two covers are not sealed, the bottom end of the middle cover 2 corresponds to the top inner wall of the sealing washer 4. When the middle cover 2 moves down, the bottom of the middle cover 2 presses against the sealing washer 4, so that the distance between the sealing washer 4 and the inner wall of the housing 14 is reduced gradually and the sealing washer 4 is allowed to fit the inner wall of the housing 14 gradually to form a seal. Similarly, when the middle cover 2 moves up, the housing 14 is gradually far away from the inner wall of the housing 14 to cancel the seal. Referring to FIG. 2, a spring 5 is mounted at the bottom of the middle cover 2 by means of a cylindrical protrusion and the bottom of the spring 5 is fixed to the lower cover 3 by means of an annular protrusion formed at the top of the lower cover 3. The elastic force of the spring 5 always acts on the middle cover 2, ensuring that the middle cover 2 fits the bottom of the upper cover 1 without falling.

Figure 6:
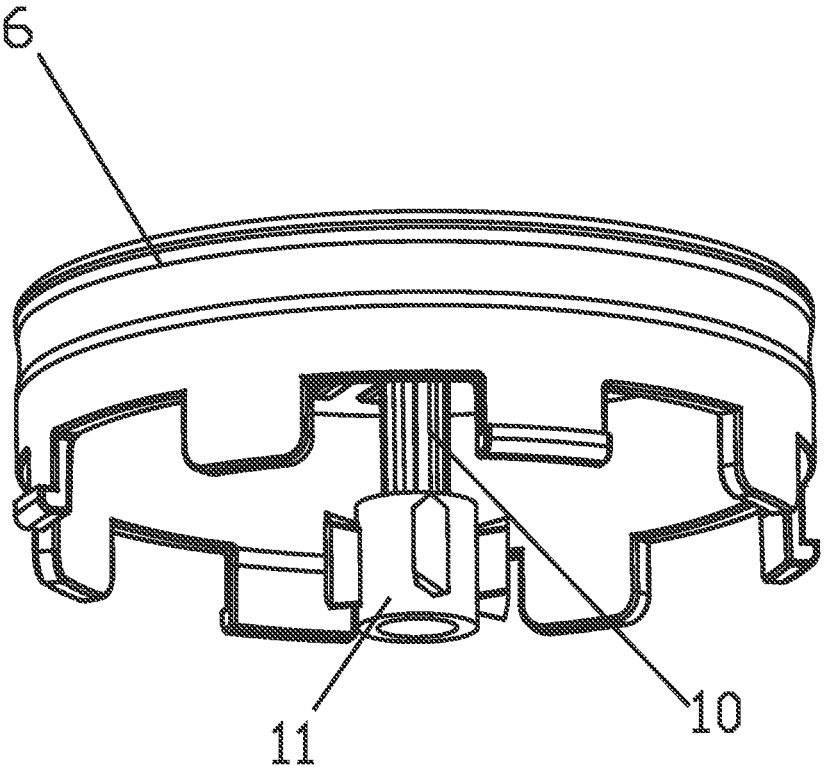
FIG. 6 is a schematic diagram of a push-push type button structure according to an embodiment of the disclosure.

A receptacle is formed in the center of the top surface of the upper cover 1 and a push-push type button 6 is mounted in the receptacle. Referring to FIG. 6, a plurality of tabs are fixedly connected to the bottom of a side wall of the push-push type button 6 and clasps corresponding to the tabs are disposed in the receptacle of the upper cover 1, whereby attachment therebetween can be realized. Two staggered turnable arms 7 are hinged in the receptacle and the top of each turnable arm 7 is in contact with the inner top wall of the push-push type button 6. A square facet 8 is disposed on the acute-angled side of the hinged joint of the turnable arm 7 and the receptacle. The square facet 8 is shaped like a triangle with an apex angle and capable of pressing against the middle cover 2 for moving down when the turnable arm 7 is pressed down to turn. A strip-shaped protrusion is formed at the apex angle of the square facet 8 and a strip-shaped slot 9 corresponding to a moving track of the apex angle of the square facet 8 is formed in the surface of the middle cover 2, whereby the stability of the middle cover 2 during moving is ensured. In addition, an opening is formed in the surface of the receptacle in a position corresponding to the square facet 8, and the lower end of the square facet 8 is capable of extending through the opening to press against the middle cover 2 below. The middle cover 2 fits the bottom of the upper cover 1 under the action of the elastic force of the spring 5, and in this case, the lower end of the square facet 8 is supported by the middle cover 2 such that the turnable arm 7 is tilted. The two staggered turnable arms 7 form a lifting mechanism.

With the structure as described above, the basic function of sealing the container and canceling the seal can be realized. Specifically, the push-push type button 6 is pressed such that a pressure is transferred by the inner top wall of the push-push type button 6 to the upper end of the turnable arm 7. In this case, the upper end of the turnable arm 7 turns along the hinged joint, and the square facet 8 presses against middle cover 2 for moving down when the turnable arm 7 is pressed down to down. When the middle cover 2 moves down, the bottom of the middle cover 2 presses against the sealing washer 4, so that the distance between the sealing washer 4 and the inner wall of the housing 14 is reduced gradually and the sealing washer 4 is allowed to fit the inner wall of the housing 14 gradually to form a seal. The seal can be canceled just by stopping pressing the push-push type button 6. Thus, the middle cover 2 moves up under the action of the elastic force of the spring 5, and the housing 14 is gradually far away from the inner wall of the housing 14.

According to the above description, it can be seen that the push-push type button 6 needs to be locked in position after being pressed down so as to maintain the seal in the cover. Therefore, a self-locking push switch is used to lock the position of the push-push type button 6 in some covers, so that the middle cover is held in the sealed or unsealed position. Such a self-locking push switch is simple to implement and secure but may still probably fail to lock. Meantime, the holding strength is unsatisfactory. Besides, the self-locking push switch is unable to bear excessive pressure exerted by the push-push type button and susceptible to damage with short service life. Thus, in this embodiment, the toggle mechanism which is more stable and durable is used to maintain the seal in the cover.

Referencing to FIG. 6, a vertically downward ejector pin 10 fixed to the inner top wall of the push-push type button 6 and the bottom of the ejector pin 10 is connected to a tumbler 11 which is capable of rotating freely. A plurality of lugs are disposed around the tumbler 11 and each lug has a bottom bevel and a top angular protrusion. A barrel sized to match the tumbler 11 is correspondingly disposed in the top wall of the receptacle of the upper cover 1. A plurality of sliding slots 12 spaced as far apart as the lugs are formed in the inner peripheral wall of the barrel, and an angular groove matching the angular protrusion is circumferentially formed in the bottom of the barrel. A tubular bulge is correspondingly formed on the top wall of the lower cover 3, and a plurality of positioning slots 13 spaced as far apart as the lugs are formed in the inner peripheral wall of the tubular bulge. Elongated sloping protrusions corresponding to the bottom bevels of the lugs are formed on the top wall of the tubular bulge. Furthermore, a round hole corresponding to the tubular bulge is formed in the surface of the middle cover 2, ensuring that the middle cover 2 is not limited when moving down. It needs to be noted that the tumbler 11, the barrel and the tubular bulge together form a toggle mechanism which is commonly used in an automatic ball-point pen. When the push-push type button 6 is pressed down, the ejector pin 10 and the tumbler 11 are pushed down by the push-push type button 6 and the tumbler 11 is allowed to extend through the barrel into the tubular bulge. The tumbler 11 is driven to turn by the bottom bevels of the lugs along the elongated sloping protrusions on the top wall of the tubular bulge. When the push-push type button 6 is released, the middle cover 2 moves up under the action of the elastic force of the spring 5, and the lower end of the square facet 8 is supported by the middle cover 2 such that the turnable arm 7 is tilted to lift the push-push type button 6 a certain distance. In this case, since the turnable arms 7 turn, the lugs on the tumbler and the sliding slots 12 in the barrel are staggered, whereby the tumbler 11 is retained below the barrel, causing the push-push type button 6 to be locked in position, i.e., maintaining the seal in the cover. Similarly, when the push-push type button 6 is pressed down again, the tumbler 11 is driven to turn again by the bottom bevels of the lugs along the elongated sloping protrusions on the top wall of the tubular bulge, so that the lugs on the tumbler 11 correspond to the sliding slots 12 in the barrel. When the push-push type button 6 is released again, the middle cover 2 moves up under the action of the elastic force of the spring 5, and the lower end of the square facet 8 is supported by the middle cover 2 such that the turnable arm 7 is tilted to lift the push-push type button 6. Meantime, the tumbler 11 passes through the barrel completely so that the push-push type button is fully lifted, thereby canceling the seal in the cover.

The foregoing are merely descriptions of preferred embodiments of the disclosure. It should be noted that a person of ordinary skill in the art may further make several improvements and modifications without departing from the principle of the disclosure, and such improvements and modifications should be deemed as falling within the protection scope of the disclosure.

What is claimed is:

1. A press type sealable container, comprising:

a housing including an open-top wall structure defining a receptacle for receiving material to be stored;

a cover disposable on the housing in a closed position relative to the receptacle and having a push-push type button;

a sealing washer disposed around the bottom of the cover, wherein a seal is formed between the sealing washer and the wall of the container only when the button is pressed and locked in position; and a toggle mechanism coupled to the button and to the sealing washer for effecting movement of the sealing washer to its compressed and uncompressed conditions respectively in response to alternate actuations of the button;

wherein the cover comprises:

an upper cover fixedly connected to a lower cover at a bottom thereof and having a receptacle at a top thereof, wherein the push-push type button is fastened over the receptacle;

the receptacle, provided therein with a lifting mechanism and having an opening in a surface thereof;

a middle cover disposed movably up and down between the upper cover and the lower cover; and the lifting mechanism extending through the opening to abut against the middle cover at a bottom thereof and abuts against the push-push type button at a top thereof;

a spring is arranged between the upper cover and the lower cover;

the toggle mechanism comprises:

an ejector pin fixed at an upper end thereof to an inner top wall of the push-push type button and connected at a lower end thereof to a tumbler which is capable of rotating freely, wherein a plurality of lugs are disposed around the tumbler and each lug has a bottom bevel and a top angular protrusion;

a barrel disposed in the receptacle in a position corresponding to the tumbler and sized to match the tumbler, wherein a plurality of sliding slots spaced as far apart as the lugs are formed in an inner peripheral wall of the barrel; and a tubular bulge formed on a top wall of the lower cover, wherein a plurality of positioning slots spaced as far apart as the lugs are formed in an inner peripheral wall of the tubular bulge and elongated sloping protrusions corresponding to the bottom bevels of the lugs are formed on a top wall of the tubular bulge; and a round hole corresponding to the tubular bulge is formed in a surface of the middle cover.

2. The press type sealable container according to claim 1, wherein the lifting mechanism consists of two turnable arms hinged in the receptacle, and a square facet is disposed on an acute-angled side of a hinged joint of each turnable arm and the receptacle and capable of extending through the opening to abut against the middle cover for moving down when the turnable arm is pressed to turn by the push-push type button.

3. The press type sealable container according to claim 1, wherein an annular clamping slot is formed circumferentially in the lower cover and a horizontal portion clamped in the clamping slot is formed at a bottom end of the sealing washer.

4. The press type sealable container according to claim 1, wherein a plurality of tabs are fixedly connected to the bottom of a side wall of the push-push type button and clasps corresponding to the tabs are disposed in the receptacle of the upper cover.

5. The press type sealable container according to claim 1, wherein the container is slightly flared on the open side and an end wall of the container on the open side is formed into an outwardly extending bevel structure.

6. The press type sealable container according to claim 1, wherein a bottom of the spring is fixed to the lower cover by means of an annular protrusion formed at a top of the lower cover.

7. The press type sealable container according to claim 2, wherein a strip-shaped protrusion is formed at an apex angle of the square facet and a strip-shaped slot corresponding to a moving track of the apex angle of the square facet is formed in the surface of the middle cover.

8. The press type sealable container according to claim 1, wherein the sealing washer has a bowl-shaped structure which is opened wider on an upper side than on a lower side thereof.

* * * * *